US006017243A

United States Patent [19]

Castaldo

[11] Patent Number: 6,017,243

[45] Date of Patent: Jan. 25, 2000

[54] STRAIN-RELIEVED, WATER-TIGHT CORD GRIP

[75] Inventor: Cosmo Castaldo, Westbury, N.Y.

[73] Assignee: Leviton Manufacturing Co., Inc., Little Neck, N.Y.

[21] Appl. No.: 09/048,858

[22] Filed: Mar. 26, 1998

[51] Int. Cl.[7] ..... H01R 13/58

[52] U.S. Cl. ..... 439/462; 174/65 SS; 439/590

[58] Field of Search ..... 439/589, 462, 439/461, 590, 885, 93, 98, 394; 174/65 SS, 66

[56] References Cited

U.S. PATENT DOCUMENTS

| | | | |
|---|---|---|---|
| 2,963,536 | 12/1960 | Kokalas | 174/77 |
| 3,581,269 | 5/1971 | Frey et al. | 339/44 |
| 3,603,912 | 9/1971 | Kelly | 339/89 C |
| 3,796,504 | 3/1974 | Marechal | 403/288 |
| 4,030,741 | 6/1977 | Marechal | 403/288 |
| 4,114,974 | 9/1978 | Fidrych | 285/161 |
| 4,145,075 | 3/1979 | Holzmann | 285/81 |
| 4,250,348 | 2/1981 | Kitagava | 174/65 |
| 5,410,104 | 4/1995 | Gretz et al. | 174/65 |
| 5,866,853 | 2/1999 | Sheehan | 174/65 |

FOREIGN PATENT DOCUMENTS

| | | | |
|---|---|---|---|
| 2204750 | 11/1988 | United Kingdom | H01R 4/24 |
| 2204750A | 11/1988 | United Kingdom . | |

*Primary Examiner*—Paula Bradley
*Assistant Examiner*—Alexander Gilman
*Attorney, Agent, or Firm*—Paul J. Sutton

[57] ABSTRACT

A kit of cord trip components which when applied to an electrical cord provide a strain-relieved, water-tight cord grip. A body having a bore with a tapered end wall and external thread portion receives a deformable bushing having a matching tapered portion. An assembly device having a second tapered end wall and an internal threaded portion receives a grip device having a plurality of displaceable fingers. When the assembly device is threaded onto the body, the deformable bushing is compressed upon a cord inserted in the cord grip to provide a water-tight seal and some strain relief while the displaceable fingers of the grip device securely grip the cord to provide the major portion of the strain relief. By changing the bushing and grip device, to ones having different diameter bores, and provided with the body and assembly device, the cord grip can accommodate a wide range of cord diameters.

12 Claims, 5 Drawing Sheets

STRAIN-RELIEVED, WATER-TIGHT CORD GRIP

BACKGROUND OF THE INVENTION

1. Field of the Invention

The invention pertains to electrical cord grip devices and more particularly to a device which provides a strain-relieved, water-tight joint with an electrical cord terminated with an electrical plug or socket or connected to an electrical box.

2. Description of the Prior Art

Prior art devices are known which employ a deformable bushing trapped between two tapered walls or between one tapered and one straight wall and deformed by the assembly of a gland nut to a body to provide a water-tight seal for an electrical cord passed therethrough. This joint also provides a limited amount of strain relief.

The prior art also shows the use of slotted bushings to provide strain relief for a cord grip but the water-tight seal is accomplished by means of separate O-rings.

One prior art device shows a cord grip which includes a deformable bushing and a grip means in the form of a circular member which provides a single gripping edge for the cord insulation and if the cord grip is overtightened can cut through the electrical cord insulation. Also since only a single size of deformable bushing and grip means is provided, the cord grip is limited as to the range of and diameters that it can accommodate. As the cord diameter increases and the grip ring is opened to accommodate such cord, the circular member is able to grip less of the cord periphery making for uneven strain relief.

SUMMARY OF THE INVENTION

The instant invention overcomes the difficulties noted above with respect to the prior art. A kit of components is provided which includes a single body and a single assembly means or gland nut and a plurality of deformable bushings and a plurality of gripping devices which can be used with the body and gland nut to handle a wide range of electrical cord diameters. The body has a first portion with a first exterior threaded region to be threadably engaged by the gland nut to assemble the cord grip. The body has a second portion which may have a second exterior threaded region to be placed in a knock-out and fastened to the electrical box wall using a locknut. Alternatively, the second portion may be an electrical plug or socket or other electrical device. The body has a bore through it. Within the first portion, the bore has a larger diameter and tapers down to a smaller diameter through the remainder of the body.

A plurality of deformable bushings is provided, all having the same exterior profile. One portion has a long taper to match that of the taper in the body. Another portion has a short tapered portion. Each of the bushings has a different sized aperture extending through it and a different sized flexible zone about the aperture. The flexible zone permits the aperture to be expanded for the larger diameter cords in its range.

A plurality of gripping devices is provided, all having the same exterior profile. A base ring, having a slot to permit expansion of the ring, as it is placed about a cord, has a plurality of deflectable fingers arranged to extend along the longitudinal axis of the cord passing through the cord grip. The fingers each have inturned tips perpendicular to the fingers, and the ends of such tips define an aperture therethrough. For the smallest aperture the tips are substantially pointed whereas for the larger apertures the tip ends are flat. The ends of the tips will fully engage the cord insulation when the grip is fully assembled. A taper on the inside of the ring matches the short tapered portion of the bushing and acts to center the grip means as the cord grip is assembled.

The final element is the assembly means or gland nut which has a first internally threaded region in a larger bore portion which threadably engages the first externally threaded portion of the body. The exit end of the gland nut has a smaller diameter bore and the transition between the two bores provides a second tapered wall. The exterior of the gland nut has a series of ridges and recesses to make assembly of the gland nut to the body easier. The second tapered wall engages the ends of the fingers of the grip device and forces the tips into intimate engagement with the cord insulation to provide excellent strain-relief. It is an object of this invention to provide a novel electrical cord grip device.

It is an object of this invention to provide an electrical cord grip device which employs a single sized body and gland nut and a plurality of deformable bushings and gripping devices with differing sized apertures to permit the cord grip to be used with a wide range of cord diameters.

It is an object of this invention to provide nesting deformable bushings and grip devices whose aperture dimensions can be altered by applying simultaneous axial forces to said bushings and said gripping devices.

It is still another object of this invention to provide a kit of components having a single body and gland nut and a plurality of deformable bushings and gripping means which can be selected according to the diameter of the cord upon which the cord grip is placed.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWING

In the drawing in which similar elements are given similar reference characters:

Turning now to FIGS. 1 to 4, there is shown a kit of components, some of which are chosen and assembled to provide a strain-relieved, water-tight electrical cord grip 20. The cord grip 20 is made up of a body 22 (see FIG. 4), a selected one of the deformable bushings 24, a selected one of the gripping devices 26 and an assembly device or gland nut 28. Body 22 has an externally threaded portion 50, a base 52 and three (only two are visible in FIG. 4) standoffs 54 with threaded bores therein (not shown). A hollow insulator shell 36 is placed along electrical cord 32 and the electrical cord 32 passes through body portion 22 and is joined to the contact connection screws 38 of plug 34. Screws 40 extend through plug 34 and enter the threaded standoffs 54 to assemble the plug 34 to the body 22. The assembled plug 34 and body 22 may now be pushed into the insulating shell 36 so that the hot and neutral contacts 42, and ground contact 44 extend beyond shell 36. A socket could be installed to body 22 in which case the front surface of the socket would within the open end of shell 36 (not shown) and the overall insulated socket would be as shown by shell 36 on the left of FIG. 14. Only the externally threaded portion 50 of body 22 extends out of the shell 36 for assembly of a gland nut thereto as will be described below.

Figure 5:
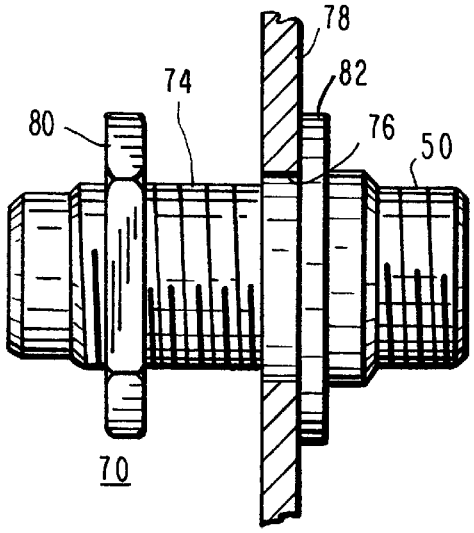
FIG. 5 is a side elevational view of a body portion for use with an electrical box.
Figure 6:
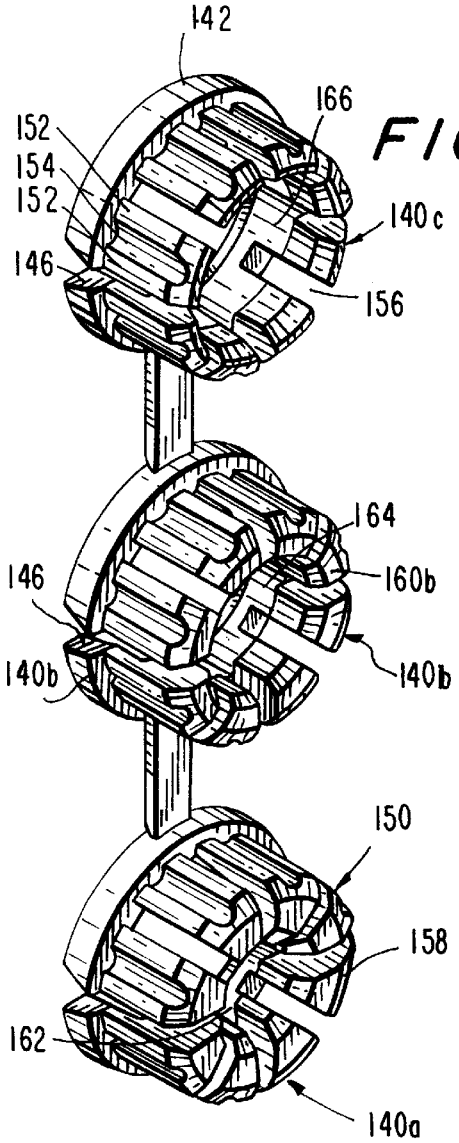
FIG. 6 is a front perspective view of a plurality of gripping devices of the kit of FIG. 2.
Figure 7:
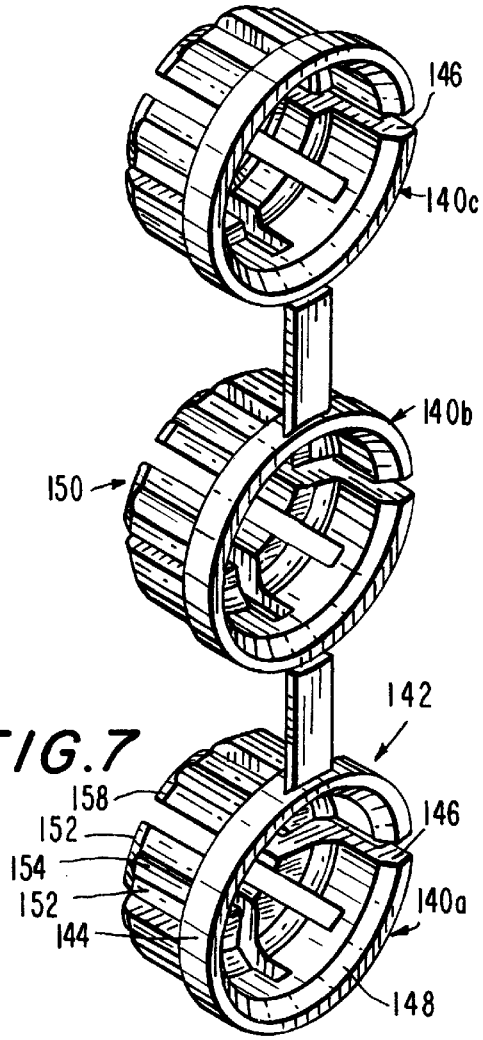
FIG. 7 is a rear perspective view of the gripping devices of FIG. 6.
Figure 11:
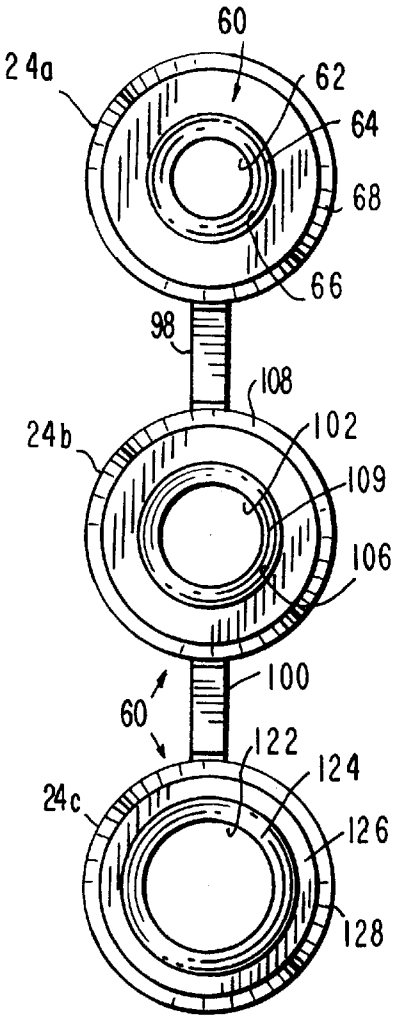
FIG. 11 is a rear elevational view of the bushings of FIG. 10.
Figure 10:
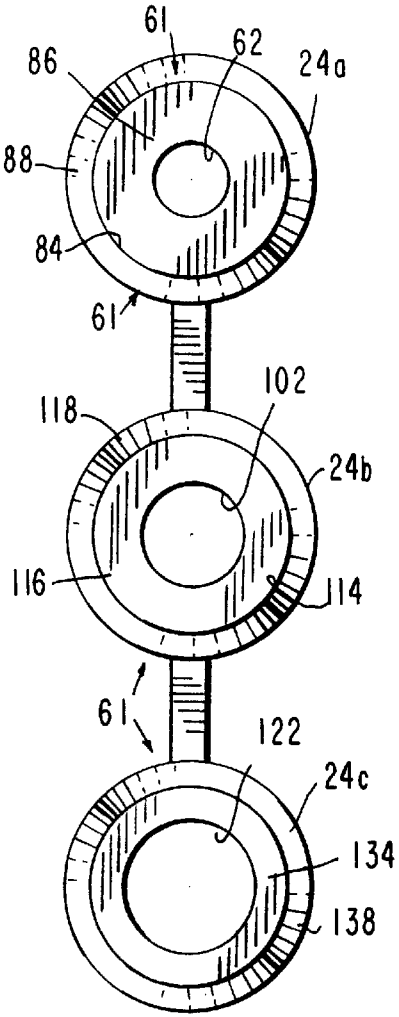
FIG. 10 is a front elevational view of a plurality of deformable bushings of the kit of FIG. 2.
Figure 9:
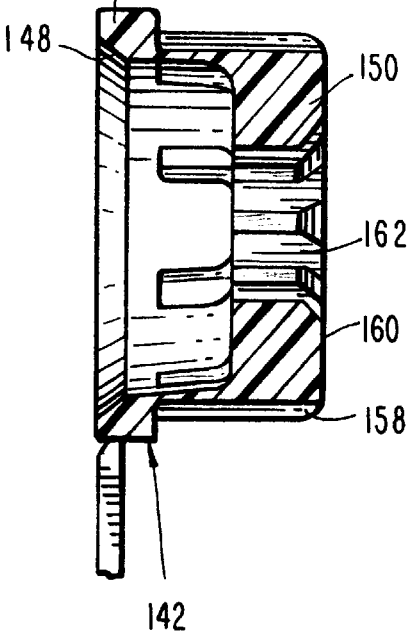
FIG. 9 is a side elevational view, in section, taken along the lines 9—9 in FIG. 8.
Figure 8:
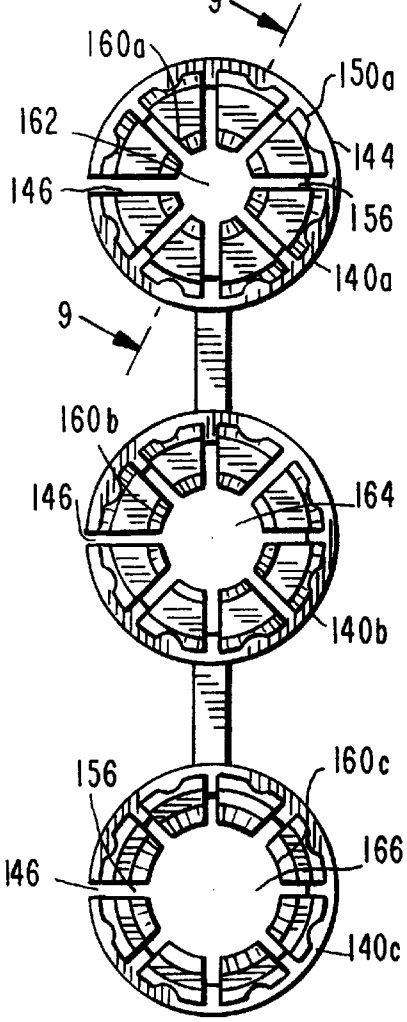
FIG. 8 is a front view of the gripping devices of FIG. 6.

A strain-relieved, water-tight joint could also be made at the entry of an electrical cord or cable into the knock-out of an electrical box. In such case a body 70 having two externally threaded portions is used (see FIG. 5). A first externally threaded portion is the same as portion 50 of body 22 and will receive a gland nut thereon. A second externally threaded portion 74 is intended to extend through a knock-out 76 in a panel 78 and receive a locknut 80 thereon so that the panel 78 is securely held between shoulder 82 and lock nut 80. The assembly of the cord grip 20 will be the same regardless of the body employed.

Figure 14:
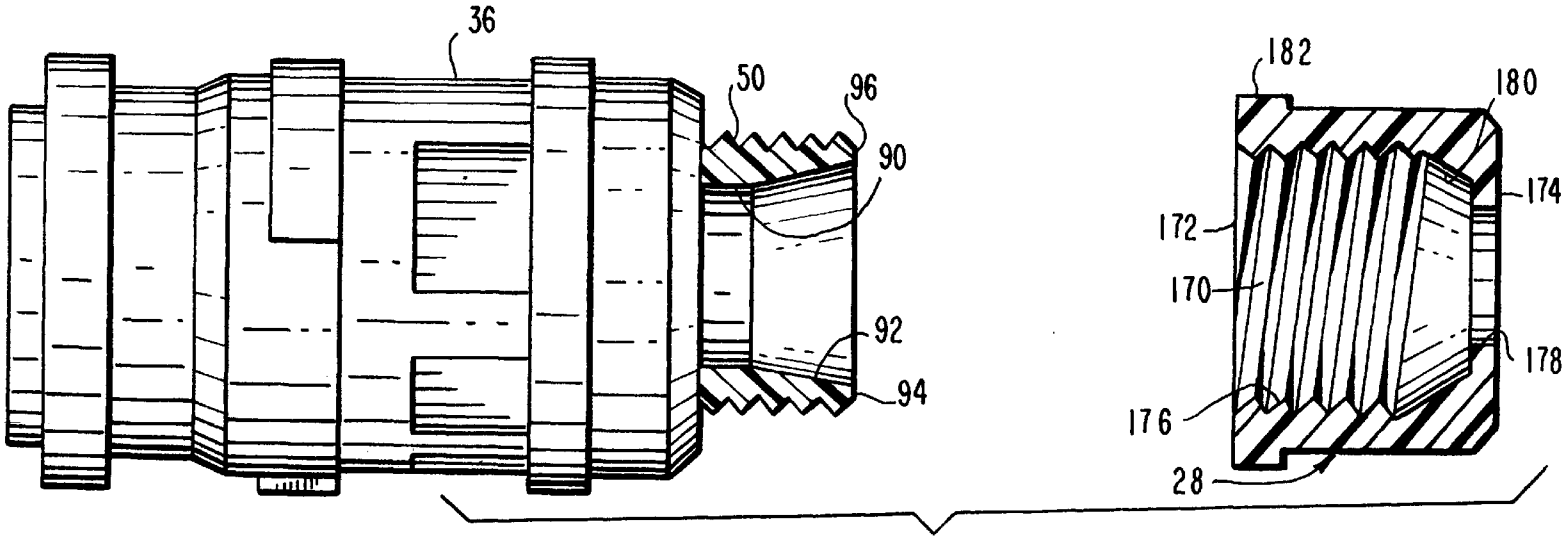
FIG. 14 is a side elevational view, partially in section, of the body and gland nut of FIG. 1 disassembled.

Referring to FIG. 14, the internal structure of body 22 and body 70 is shown. A bore 90 extends completely through the bodies 22 and 70. From a point within the body 22, at about where the externally threaded portion 50 begins, the bore is tapered outwardly as at 92 to leave a thin wall 94 at leading edge 96. The remainder of the bore 90 is generally uniform for the remainder of bodies 22 and 70.

The element to provide the water-tight seal about the electrical cord and provide some strain relief is the deformable bushing 24 shown in FIGS. 2, 3 and 10 to 14. As shown by these figures, a plurality of deformable bushings 24*a*, 24*b* and 24*c* are provided, each attached to an adjacent bushing in a chain-like fashion. Although only three bushings are shown, this number can be increased or decreased as desired. Each of the bushings 24*a*, 24*b* and 24*c* have the same external profile. The profile of these bushings 24 includes a long tapered surface 56 at trailing edge 61 which matches the taper 92 of bodies 22 and 70. A short tapered surface 58 is formed at the leading edge 60 of bushing 24. The short tapered surface 58 will mate with a tapered surface on the gripping means to help center the gripping means on the deformable bushing 24. Bushing 24*a* is intended to handle the smallest cords in the range of cord diameters the cord grip 20 can handle. Thus it has the smallest bore 62 extending from leading edge 60 trailing edge 61. A highly flexible and stretchable region 64 about bore 62 is provided by counterbore 66 which leaves a wide rim 68. A rib 70 about bore 62 prevents the stretching of bore 62 to the point of tearing region 64. A counterbore 84 about bore 62 from the trailing edge 61 leaves a flexible and stretchable region 86, wider than the similar region 64, and a rim 88 narrower than rim 68. The thickness of rim 88 and the wide region 86 permits the entire deformable bushing 24*a* to be compressed as the bushing 24*a* is forced along tapered wall 92 of body 22 to securely grip the perimeter of cord 32 and provide a water-tight joint with some strain relief. The thick rim 88 prevents the bushing from collapsing and provides an adequate surface to engage the gripping device as will be described below. The flexible and stretchable regions 64 and 86 allow the bore 62 to be enlarged by radial compression of the regions if the diameter of the cord is not too much greater than the original bore 62 diameter. For larger diameter cords, a portion of the region 68, 86 may be displaced along the surface of the cord in the direction of the longitudinal axis of the cord.

Bushing 24*b* has a larger bore 102 than bore 62 of bushing 24*a* to receive the middle range of cord diameters. Counterbore 106 provides a flexible and stretchable region 109 and wall ending in rim 108 which is thinner than the wall ending in rim 68 so that a range of larger cord diameters can be handled and also because of the larger cord diameter there is less chance of collapsing the bushing 24*b* during assembly. A rib 103 surrounds bore 102 to prevent overstretching of the bore 102 and possible injury to the regions 109. Counterbore 114 leaves region 116 about bore 102 and a wall ending in rim 118. The bushing to handle the range of largest cords is 24*c* which has a central bore 122, counterbored as at 126 to provide region 124 about bore 122 and a wall ending in rim 128 at leading edge 60. From trailing edge 61, a counterbore 136 provides a wall extending to rim 138 and a flexible and stretchable region 134. The tether 98 joins bushing 24*a* to bushing 24*b* while tether 100 extends between bushings 24*b* and 24*c*. The tethers 98 and 100 keep the bushings together in a chain-like fashion until the bushings are to be used and then they are separated by severing the joint between the tethers and bushings. The tethers 98 and 100 are formed at the same time as the bushings are molded and may be the mold runners between adjacent mold cavities.

Figure 13:
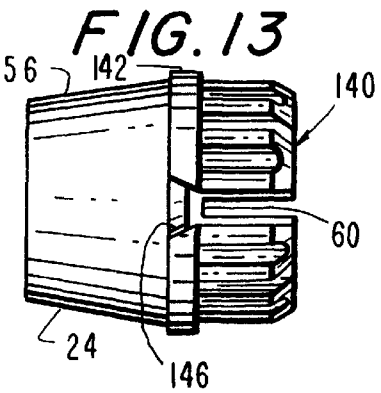
FIG. 13 is a side elevational view of the devices of FIG. 12 fully assembled.
Figure 12:
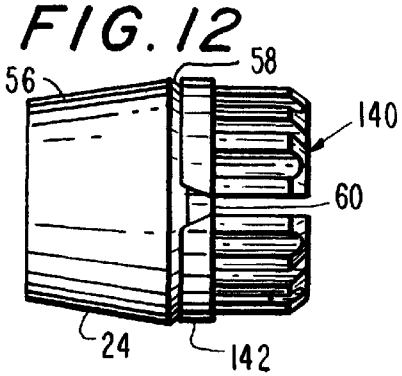
FIG. 12 is a side elevational view of a deformable bushing and a gripping means in their initial contact position.

Turning now to FIGS. 6 to 9, 12 and 13, there is shown a plurality of gripping devices, one of which is employed as part of the cord grip 20. The grip devices 140 are also formed to have a uniform exterior profile and the size range of cord diameters which individual gripping devices 140 are arranged to handle is determined by the size of the aperture defined by the tips of the displaceable fingers of each gripping device 140. Unlike the deformable bushings 24 the interior profile of each of the gripping devices 140 is also the same. A base ring 142 has a flat cylindrical surface 144 which is split as at 146 so that ring 142 can be opened to permit it to be placed about an electrical cord (not shown). The inner bottom edge of base ring 142 is chamfered, as at 148 (see FIG. 9) to accept the short tapered surface 58 at the leading edge 60 of a bushing 24 and center the gripping device 140 and hold it in proper position during assembly of the gripping device 140 before the cord is introduced into gripping device 140. As shown in FIG. 12, the gripping device 140 is positioned on bushing 24 surface 58 but the gripping device 140 is not fully seated. FIG. 13 shows the gripping device 140 fully seated on the bushing 24 with no portion of surface 58 exposed. This occurs as the base ring 142 expands to accept the surface 58 of bushing 24. In this position the assembly of the gland nut 28 to body 22 permits the gripping device 140 to be actuated as will be described below.

Referring now to FIGS. 6 to 9, a plurality of displaceable fingers 150 extend from base ring 142. Each of the fingers 150 is made up of two substantially parallel ribs 152 perpendicular to base ring 142 with a thin web 154 joining them. This provides an increased flexibility of fingers 150 over a solid finger. The fingers 150 are separated by slots 156 which allows each finger to be separately displaced and to a different degree if the cord is not completely symmetrical. Each of the fingers 150 ends in a chamfered surface 158 which engages a tapered wall in the gland nut 28 to cause the fingers 150 to be displaced into intimate contact with the cord insulation. One of the slots 156 is aligned with the split 146 of base ring 142 so that the gripping device 140 can be installed on a cord.

On the interior, free ends of fingers 150 there are placed inturned tips 160. The tips 160 each have a length and an end surface which engages the cord insulation and its length and shape are determined by the diameter of the cord with which it is used. The tips 160*a* of gripping device 140*a* are long and end in substantially pointed surface, which describe a small passageway 162 therebetween. The tips 160*b* are shorter than tips 160*a* and have a rounded end surface much wider than tips 160*a* and define a larger passageway 164. The largest end surface and the shortest tips are those of gripping device 140*c*. Tips 160*c* define a passageway 166.

FIG. 14 shows the interior of assembly device or gland nut 28. A bore 170 extends from an open end 172 to a partially closed end 174. The bore 170 adjacent open end 172 and extending almost to partially closed end 174 is internally threaded as at 176 to threadably engage exterior thread 50 of body 22 and permit their assembly. Partially closed end 174 has a cord aperture 178 therethrough. Extending from the end of threaded portion 176 to the partially closed end 174 is a tapered surface 180. The engagement of the chamfered surface 158 of gripping device 140 with tapered surface 180 of gland nut 28 controls the position of the fingers 150 and the degree of engagement of tips 160 with a cord extending through cord grip 20. A collar 182 extends about the exterior of gland nut 28 at open end 172 and a series of ribs 184 with recesses 186 between them extend about the outer periphery of gland nut 28 to facilitate installation and removal of the gland nut 28 from body 22.

Figure 4:
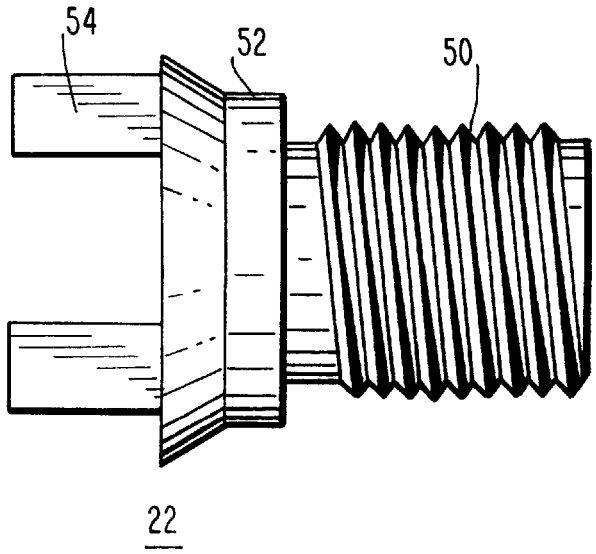
FIG. 4 is a side elevational view of the body portion of the cord grip of FIG. 2.

To use the cord grip 20 with an electrical plug 34, a body 22 as shown in FIG. 4 would be employed. A deformable bushing 24 having a bore diameter which is somewhat less than the diameter of cord 32 would be selected and its trailing edge 61 inserted into the bore of body 22 with the long tapered surface 56 engaging tapered wall 92 of body 22. Next the cord is inserted through aperture 178 of gland nut 28 and gland nut 28 is moved away from the cord 32 end. Then a gripping device 140, having a passageway with a diameter somewhat less than the cord 32 diameter, is placed about the cord 32 by opening the base ring 142 at split 146 and separating the fingers 150 at the associated slot 156 and with the chamfered inner edge 148 facing the short tapered edge 58 of bushing 24 and spaced away from the cord 32 end. The cord 32 is now passed through the bore of bushing 24 and body 22 with the end of cord 32 beyond the end of shell 36.

Figure 1:
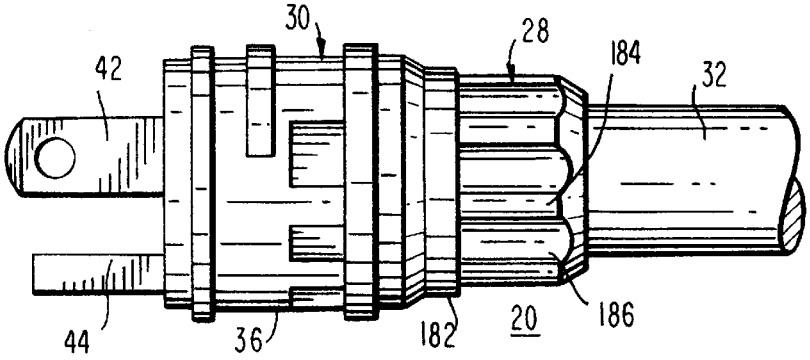
FIG. 1 is a side elevational view of an assembled cord grip constructed in accordance with the concepts of the invention.
Figure 2:
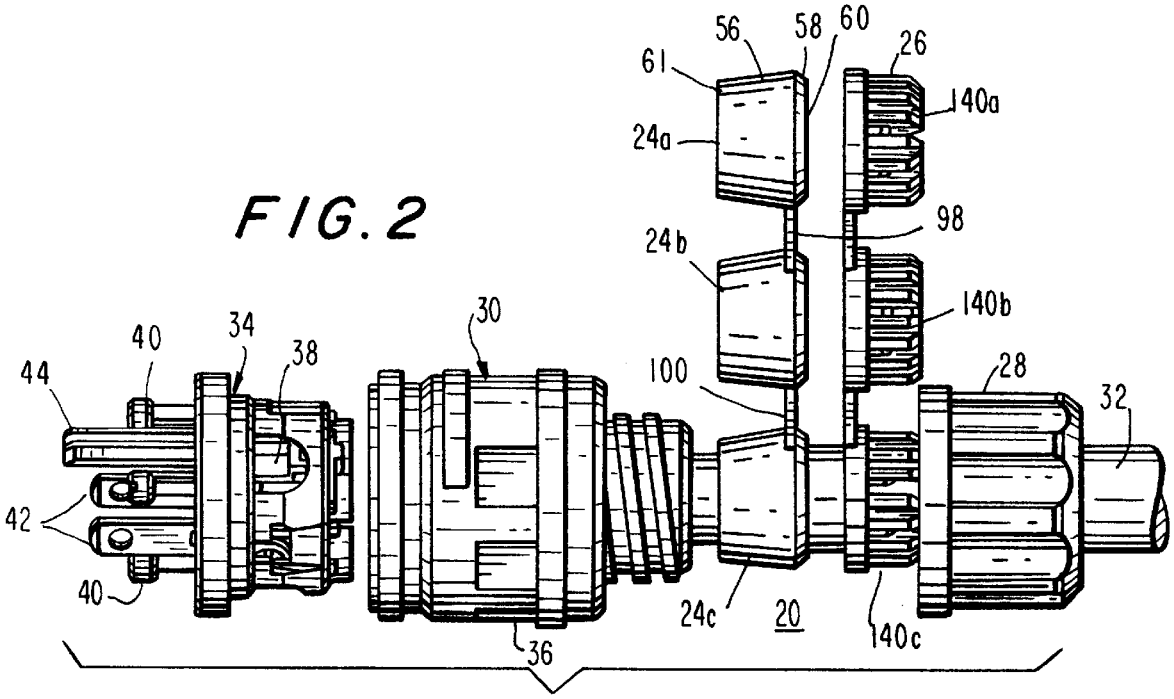
FIG. 2 is a side view, exploded, of a kit of components of a cord grip, constructed in accordance with the concepts of the invention, and showing the cord grip employed with an electrical plug.
Figure 3:
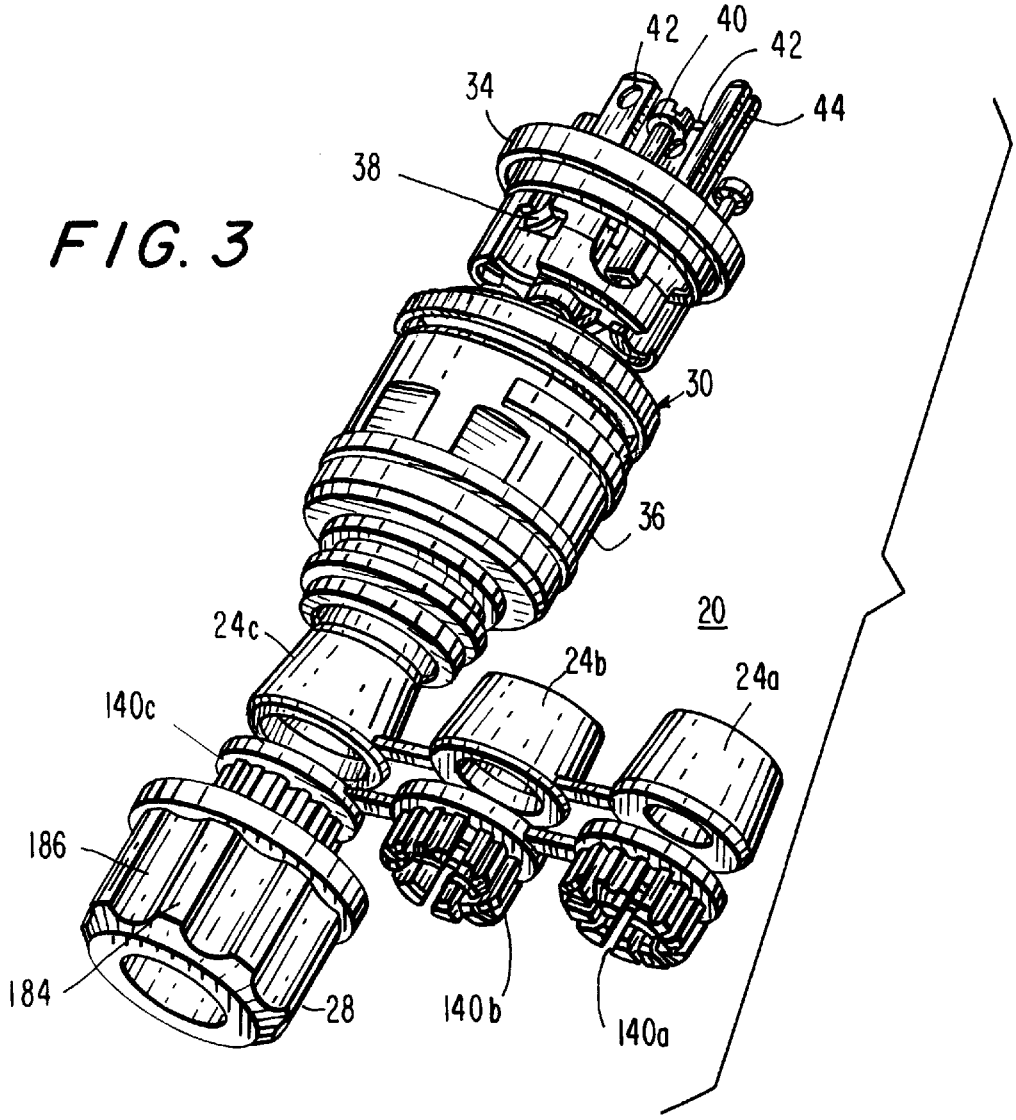
FIG. 3 is an exploded, perspective view of the device of FIG. 2.

The end of the cord and the individual conductors are prepared and attached to the appropriate contact connection screws 38 (see FIG. 2). The plug 34 is assembled to the body 22 using screws 40 and threaded standoffs 54. The assembled plug 34 and body 22 may now be pushed into insulating shell 36 and any excess cord 32 pulled through body 22. The gripping device 140, previously placed about cord 32, is advanced along cord 32 until the chamfered edge 148 of gripping device 140 engages short tapered surface 58 of bushing 24 (see FIG. 12). The gland nut 28 is now advanced towards the exposed end of body 22 and the internal threads 176 of gland nut 28 engage the external threads 50 of body 22.

As the gland nut 28 is advanced by pressure applied to the external ribs 184, the gripping device 140 is fully seated upon bushing 24, the chamfered edge 158 of gripping device 140 is in full contact with tapered surface 180 of gland nut 28 and the long tapered portion 56 of bushing 24 is in full contact with the tapered wall 92 of body 22.

Further advancing of the gland nut 28 on the body 22 will compress bushing 24 radially and the area about the bore in the bushing 24 will tightly grip the cord 32 exterior providing a good water-tight joint. Some strain relief is also afforded by such joint. As the tapered wall 180 of the gland nut 28 acts upon the chamfered ends 158 of gripping device 140, the fingers 150 are displaced inwardly so that tips 160 securely grip the cord 32 insulation providing excellent strain relief. The gland nut 28 is advanced to hand tightness and no tool is necessary and if used may injure the cord 32. To disassemble the cord grip 20 from cord 32 the above steps are reversed.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A strain-relieved, watertight cord grip comprising:

a. a substantially cylindrical body having a first end and a second end and a bore extending therethrough from said first end to said second end substantially concentric with a longitudinal axis of said cylindrical body, said bore adapted to receive an electrical cord therein;

b. said bore being outwardly tapered from a point between said first and second ends to said second end to provide a first frusto-conical wall adjacent said second end;

c. said body having an externally threaded portion adjacent said second end and substantially overlying said first frusto-conical wall;

d. a deformable bushing having a first end and a second end and a bore therethrough;

e. said deformable bushing having a tapered outer surface adjacent said first end, said tapered outer surface of said deformable bushing being complementary to said first frusto-conical wall of said cylindrical body;

f. grip means having a base ring at a first end and a plurality of displaceable fingers extending therefrom towards a second end, the tips of said fingers describing at said second end a cord passageway, said grip means adapted to be positioned to align said fingers with said longitudinal axis of said body;

g. each of said displaceable fingers comprises:

h. first rib means extending from said base ring to said finger tip;

i. second rib means, substantially parallel with and spaced apart from said first rib means;

j. thin web means connected to and between said first and second rib means whereby said fingers have a reduced cross-section and are more easily displaceable;

k. assembly means having a cylindrical body member having a first open end and a second partially closed end and a bore extending from said first end towards said second end;

l. a second frusto-conical wall extending from the bore in said assembly means between said first end and said second end to said partially closed end;

m. said second frusto-conical wall acting upon said fingers to control the size of said cord passageway; and n. at least a portion of said assembly means bore being internally threaded to threadably engage said body externally threaded portion to assemble said cord grip upon an electrical cord.

2. A strain-relieved, watertight cord grip comprising:

a. a substantially cylindrical body having a first end and a second end and a bore extending therethrough from said first end to said second end substantially concentric with a longitudinal axis of said cylindrical body, said bore adapted to receive an electrical cord therein;

b. said bore being outwardly tapered from a point between said first and second ends to said second end to provide a first frusto-conical wall adjacent said second end;

c. said body having an externally threaded portion adjacent said second end and substantially overlying said first frusto-conical wall;

d. a deformable bushing having a first end and a second end and a bore therethrough;

e. said deformable bushing having a tapered outer surface adjacent said first end, said tapered outer surface of said deformable bushing being complementary to said first frusto-conical wall of said cylindrical body;

f. grip means having a base ring at a first end and a plurality of displaceable fingers extending therefrom towards a second end, the tips of said fingers describing at said second end a cord passageway, said tips of said fingers extending perpendicular to the longitudinal axis of said body;

g. each of said displaceable fingers comprising:

h. first rib means extending from said base ring to said finger tip;

i. second rib means substantially parallel with and spaced apart from said first rib means;

j. thin web means connected to and between said first and said second rib means whereby said fingers have a reduced cross-section and are more easily displaceable;

k. said grip means being adapted to be positioned to align said fingers with the longitudinal axis of said body;

l. assembly means having a substantially cylindrical body member having a first open end and a second partially closed end and a bore extending from said first end towards said second end;

m. a second frusto-conical wall extending from the bore in said assembly means between said first end and said second end to said partially closed end;

n. said second frusto-conical wall acting upon said fingers to control the size of said cord passageway; and o. at least a portion of said assembly means bore being internally threaded to threadably engage said body externally threaded portion to assemble said cord grip upon an electrical cord.

3. A strain-relieved, water-tight cord grip comprising:

a. a substantially cylindrical body having a first end a second end and a bore extending therethrough from said first end to said second end substantially concentric with a longitudinal axis of said cylindrical body, said bore adapted to receive an electrical cord therein;

b. said bore being outwardly tapered from a point between said first and second ends to said second end to provide a first frusto-conical wall adjacent said second end;

c. said body having an externally threaded portion adjacent said second end and substantially overlying said frusto-conical wall;

d. a deformable bushing having a first end and a second end and a bore therethrough;

e. said deformable bushing having a tapered outer surface adjacent said first end, said tapered outer surface of said deformable bushing being complementary to said first frusto-conical wall of said cylindrical body;

f. grip means having a base ring at a first end a plurality of displaceable fingers extending therefrom towards a second end, the tips of said fingers describing at a said second end a cord passageway, said tips of said fingers are substantially flat to securely grip a cord extending through said cord passageway, said grip means adapted to be positioned to align said fingers with the longitudinal axis of said body;

g. each of said displaceable fingers comprises:

h. first rib means extending from said base ring to said finger tip;

i. second rib means, substantially parallel with and spaced apart from said first rib means;

j. thin web means connected to and between said first and second rib means whereby said fingers have a reduced cross-section and are more easily displaceable;

k. assembly means having a substantially cylindrical body member having a first open end and a second partially closed end and a bore extending from said first end towards said second end;

l. a second frusto-conical wall extending from the bore in said assembly means between said first end and said second end to said partially closed end;

m. said second frusto-conical wall acting upon said fingers to control the size of said cord passageway; and n. at least a portion of said assembly means bore being internally threaded to threadably engage said body externally threaded portion to assemble said cord grip upon an electrical cord.

4. A strain-relieved, water-tight cord grip comprising:

a. a substantially cylindrical body having a first end and a second end and a bore extending therethrough from said first end to said second end substantially concentric with a longitudinal axis of said cylindrical body, said bore adapted to receive an electrical cord therein;

b. said bore being outwardly tapered from a point between said first and second ends to said second end to provide a first frusto-conical wall adjacent said second end;

c. said body having an externally threaded portion adjacent said second end and substantially overlying said frusto-conical wall;

d. a deformable bushing having a first end and a second end and a bore therethrough;

e. said deformable bushing having a tapered outer surface adjacent said first end, said tapered outer surface of said deformable bushing being complementary to said first frusto-conical wall of said cylindrical body;

f. grip means having a base ring at a first end and a plurality of displaceable fingers extending therefrom towards a second end, the tips of said fingers describing at said second end a cord passageway, the tips of said fingers extend perpendicular to the longitudinal axis of said body and are substantially flat to securely grip a cord extending through said cord passageway, said grip means adapted to be positioned to align said fingers with the longitudinal axis of said body;

g. each of said displaceable fingers comprises:

h. first rib means extending from said base ring to said finger tip;

i. second rib means, substantially parallel with and spaced apart from said first rib means;

j. thin web means connected to and between said first and second rib means whereby said fingers have a reduced cross-section and are more easily displaceable;

k. assembly means having a substantially cylindrical body member having a first open end and a second partially closed end and a bore extending from said first end towards said second end;

l. a second frusto-conical wall extending from the bore in said assembly means between said first end and said second end to said partially closed end;

m. said second frusto-conical wall acting upon said fingers to control the size of said cord passageway; and n. at least a portion of said assembly means bore being internally threaded to threadably engage said body externally threaded portion to assemble said cord grip upon an electrical cord.

5. In a strain-relieved, water-tight cord grip of the type having a cylindrical body, a deformable bushing, a grip means and an assembly means, the improvement comprising:

a. a plurality of deformable bushings joined one to another in a chain-like fashion, each of said bushings having the same exterior profile;

b. each of said bushings having a bore therethrough, said bore having a diameter adapted to receive a range of cord diameters therethrough;

c. a wall of said bore of said deformable bushing; and d. an aperture in said wall proportioned to permit a cord, within the range of cord diameters which the associated bore can receive, to pass therethrough in sealing engagement with the wall that defines such aperture; said wall defining said aperture gripping said cord more tightly as the first end of said deformable bushing is forced into said body along a first frusto-conical wall in said body, whereby a deformable bushing having an aperture to receive the inserted cord is separated from the chain of such bushings and positioned between said body and said grip means to receive the inserted cord.

6. In a strain-relieved, water-tight cord grip of the type having a cylindrical body, a deformable bushing, a grip means and an assembly means, the improvement comprising:

a. a plurality of grip means joined one to another in a chain-like fashion, each of said grip means having the same external profile;

b. each of said grip means having a base ring at a first end and a plurality of displaceable fingers extending away from said ring, the tips of said fingers at a second free end describing a cord passageway, each of said grip means adapted to be positioned between said deformable bushing and said assembly means with said fingers aligned with the longitudinal axis of said body;

c. said passageway having an initial diameter adapted to receive a range of cord diameters therethrough; and d. said passageway diameter is reduced from said initial diameter and the tips of said fingers caused to bite into the insulation of a cord having a diameter in the range of cord diameters the passageway is arranged to receive and passed through said cord grip as said fingers are forced towards one another by their engagement with an inner surface of said assembly means, whereby a grip means having a passageway to receive the inserted cord is separated from the chain of such grip means and positioned between said deformable bushing and said assembly means to receive the inserted cord.

7. In a strain-relieved, water-tight cord grip of the type having a cylindrical body, a deformable bushing, a grip means and an assembly means, the improvement comprising:

a. a plurality of deformable bushings joined one to another in a chain-like fashion, each of said bushings having the same exterior profile;

b. each of said bushings having a bore therethrough, said bore having a diameter adapted to receive a range of cord diameters therethrough;

c. a wall of said bore of said deformable bushing;

d. an aperture in said wall proportioned to permit a cord, within the range of cord diameters which the associated bore can receive, to pass therethrough in sealing engagement with the wall that defines such aperture; said wall defining said aperture gripping said cord more tightly as the first end of said deformable bushing is forced into said body along a first frusto-conical wall in said body, whereby a deformable bushing having an aperture to receive the chosen cord is separated from the chain of such bushings and positioned between said body and said grip means to receive the chosen cord;

e. a plurality of grip means joined one to another in a chain-like fashion, each of said grip means having the same exterior profile;

f. each of said grip means having a base ring at a first end and a plurality of displaceable fingers extending away from said ring, the tips of said fingers at a second, free end describing a cord passageway, each of said grip means adapted to be positioned between said deformable bushing and said assembly means with said fingers aligned with the longitudinal axis of said body;

g. said passageway having an initial diameter adapted to receive a range of cord diameters therethrough; and h. said passageway diameter is reduced from said initial diameter and the tips of said fingers caused to bite into the insulation of a cord, having a diameter in the range of cord diameters the passageway is arranged to receive, passed through said cord grip as said fingers are forced towards one another by their engagement with a second frusto-conical wall in said assembly means, whereby a grip means having a passageway to receive the inserted cord is separated from the chain of such grip means and positioned between said deformable bushing and said assembly means to receive the inserted cord.

8. A strain-relieved, water-tight cord grip for use with electrical cords having a wide range of diameters, a kit of cord grip components comprising:

a. a substantially cylindrical body having a first end and a second end and a bore extending therethrough from said first end to said second end substantially concentric with the longitudinal axis of said cylindrical body, said bore adapted to receive an electrical cord therein;

b. said bore being outwardly tapered from a point between said first and second ends to said second end to provide a first frusto-conical wall adjacent said second end;

c. said body having an externally threaded portion adjacent said second end and substantially overlying said frusto-conical wall;

d. a plurality of deformable bushings each having a first end and a second end and a bore therethrough and a tapered outer surface adjacent said first end, said tapered outer surface of said deformable bushing being complementary to said frusto-conical wall of said cylindrical body, each of said bushings having the same exterior profile;

e. each of said deformable bushings having a different diameter bore therethrough to accept different ones of the range of cord diameters which the cord grip can accommodate;

f. said deformable bushings being connected to one another in a chain-like fashion whereby the deformable bushing having a bore diameter to accept the cord diameter can be separated from the other deformable bushings and placed in said cylindrical body bore;

g. grip means having a base ring at a first end and a plurality of displaceable fingers extending therefrom towards a second end, the types of said fingers describing at said second free end, a cord passageway, said grip means adapted to be positioned to align said fingers with the longitudinal axis of said body;

h. assembly means having a substantially cylindrical body member having a first open end and a second partially closed end and a bore extending from said first end towards said second end;

i. a second frusto-conical wall extending from the bore in said assembly means between said first end and said second end to said partially closed end;

j. said second frusto-conical wall acting upon said fingers to control the diameter of said cord passageway; and k. at least a portion of said assembly means bore being internally threaded to threadably engage said body externally threaded portion to assemble said cord grip upon an electrical cord.

9. A strain-relieved, water-tight cord grip for use with electrical cords having a wide range of diameters, a kit of cord grip components comprising:

a. a substantially cylindrical body having a first end and a second end and a bore extending therethrough from said first end to said second end substantially concentric with the longitudinal axis of said cylindrical body, said bore adapted to receive an electrical cord therein;

b. said bore being outwardly tapered from a point between said first and second ends to said second end to provide a first frusto-conical wall adjacent said second end;

c. said body having an externally threaded portion adjacent said second end and substantially overlying said frusto-conical wall;

d. a deformable bushing having a first end and a second end and a bore therethrough;

e. said deformable bushing having a tapered outer surface adjacent said first end, said tapered outer surface of said deformable bushing being complementary to said frusto-conical wall of said cylindrical body;

f. a plurality of grip means each having a base ring at a first end and a plurality of displaceable fingers extending away from said ring, the tips of said fingers at a second free end, describing a cord passageway, each of said grip means adapted to be positioned between said deformable bushing and an assembly means with said fingers aligned with the longitudinal axis of said body;

g. each of said grip means having a different initial diameter passageway to accept different ones of the range of cord diameters which the cord grip can accommodate;

h. said passageway diameter is reduced from said initial diameter and the tips of said fingers caused to bite into the insulation of a cord, having a diameter in the range of cord diameters the passageway is arranged to accommodate and passed through said cord grip means as said fingers are forced towards one another by their engagement with a second frusto-conical wall in an assembly means;

i. said grip means being connected to one another in a chain-like fashion whereby the grip means having a passageway diameter to accept the cord diameter to be inserted in said cord grip can be separated from the other grip means and placed adjacent the exposed face of said deformable bushing in said body;

j. assembly means having a substantially cylindrical body member having a first open end and a second partially closed end and a bore extending from said first end towards said second end;

k. a second frusto-conical wall extending from the bore in said assembly means between said first and said second end to said partially closed end;

l. said second frusto-conical wall acting upon said fingers to control the diameter of said cord passageway; and m. at least a portion of said assembly means bore being internally threaded to threadably engage said body externally threaded portion to assemble said cord grip upon an electrical cord.

10. A strain-relieved, water-tight cord grip for use with electrical cords having a wide range of diameters, a kit of cord grip components comprising:

a. a substantially cylindrical body having a first end and a second end and a bore extending therethrough from said first end to said second end substantially concentric with the longitudinal axis of said cylindrical body, said bore adapted to receive an electrical cord therein;

b. said bore being outwardly tapered from a point between said first and second ends to said second end to provide a first frusto-conical wall adjacent said second end;

c. said body having an externally threaded portion adjacent said second end and substantially overlying said frusto-conical wall;

d. a plurality of deformable bushings each having a first end and a second end and a bore therethrough and a tapered outer surface adjacent said first end, said tapered outer surface of said deformable bushing being complementary to said frusto-conical wall of said cylindrical body, each of said bushings having the same exterior profile;

e. each of said deformable bushings having a different diameter cord therethrough to accept different ones of the range of cord diameters which the cord grip can accommodate;

f. said deformable bushing being connected to one another in a chain-like fashion whereby the deformable bushing having a bore diameter to accept the cord diameter can be separated from the other deformable bushings and placed in said cylindrical body bore;

g. a plurality of grip means each having a base ring at a first end and a plurality of displaceable fingers extending away from said ring, the tips of said fingers at a second free end, describing a cord passageway, each of said grip means adapted to be positioned between said deformable bushing and an assembly means with said fingers aligned with the longitudinal axis of said body;

h. each of said grip means having a different initial diameter passageway to accept different ones of the range of cord diameters which the cord grip can accommodate;

i. said passageway diameter is reduced from said initial diameter and the tips of said fingers caused to bite into the insulation of a cord, having a diameter in the range of cord diameters the passageway is arranged to accommodate and passed through said cord grip means as said fingers are forced towards one another by the engagement with a second frusto-conical wall in an assembly means;

j. said grip means being connected to one another in a chain-like fashion whereby the grip means having a passageway diameter to accept the cord diameter to be inserted in said cord grip can be separated from the other grip means and placed adjacent the exposed face of said deformable bushing in said body;

k. assembly means having a substantially cylindrical body member having a first open end and a second partially closed end and a bore extending from said first end towards said second end;

l. a second frusto-conical wall extending from the bore in said assembly means between said first and said second end to said partially closed end;

m. at least a portion of said assembly means bore being internally threaded to threadably engage said body externally threaded portion to assemble said cord grip upon an electrical cord.

11. The method of assembling a strain-relieved, water-tight cord grip usable with a range of cord diameters to an electrical cord comprising the steps of:

a. selecting one deformable bushing having a bore to accommodate a selected cord and separating such bushing from a plurality of such bushings connected one to another in chain-like fashion, each having different bore sizes to accept certain cords in said range;

b. inserting said bushing in the tapered bore of a cord grip body having an externally threaded portion;

c. applying an assembly device having a bore therethrough and a portion of said bore containing an internal thread to a portion of the externally threaded body;

d. inserting a cord through the bores of said cord grip body, said deformable bushing and said assembly device; and e. advancing said assembly device fully onto said cord grip body to deform said deformable bushing and cause said bushing to tightly grip said cord.

12. The method of assembling a strain-relieved, water-tight cord grip usable with a range of cord diameters to an electrical cord comprising the steps of:

a. selecting one deformable bushing having a bore to accommodate a selected cord and separating such bushing from a plurality of such bushings connected one to another in chain-like fashion, each having different bore sizes to accept certain cords in said range;

b. inserting said bushing in the tapered bore of a cord grip body having an externally threaded portion;

c. selecting one cord grip means having a passageway between its fingers aligned with the longitudinal axis of said body, said passageway having a diameter to permit said selected cord to pass therethrough, and separating such cord grip means from a plurality of such cord grip means connected one to another in chain-like fashion, each having a passageway of a different diameter to accept certain ends in said range;

d. inserting said cord grip means into the bore of an assembly device having a bore therethrough and a portion of said bore containing an internal thread;

e. threading by engaging the internally threaded portion of said assembly device to the externally threaded portion of said cord grip body; and f. advancing said assembly device fully onto said cord grip body to deform said deformable bushing and closing said cord grip means passageway to cause said bushing to tightly grip said cord and causing the tips of said fingers to bite into the insulation of said cord to provide a strain-relief and water-tight joint between said cord and said cord grip.

* * * * *